US010396502B2

(12) United States Patent
Tian et al.

(10) Patent No.: US 10,396,502 B2
(45) Date of Patent: Aug. 27, 2019

(54) ELECTRICAL CONNECTOR WITH METALLIC SHELL CURVED EXTENDING AND COVERING AN INTERIOR SURFACE OF A MATING CAVITY

(71) Applicant: FOXCONN INTERCONNECT TECHNOLOGY LIMITED, Grand Cayman (KY)

(72) Inventors: Xiao-Xian Tian, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/956,682

(22) Filed: Apr. 18, 2018

(65) Prior Publication Data

US 2018/0309244 A1 Oct. 25, 2018

(30) Foreign Application Priority Data

Apr. 19, 2017 (CN) ..... 2017 1 0255529

(51) Int. Cl.

| | |
|---|---|
| ***H01R 13/6594*** | (2011.01) |
| ***H01R 13/6581*** | (2011.01) |
| ***H01R 12/71*** | (2011.01) |
| *H01R 13/41* | (2006.01) |
| *H01R 13/6587* | (2011.01) |

(Continued)

(52) U.S. Cl.

CPC ..... *H01R 13/6581* (2013.01); *H01R 12/716* (2013.01); *H01R 13/6594* (2013.01); *H01R 12/721* (2013.01); *H01R 12/727* (2013.01); *H01R 13/41* (2013.01); *H01R 13/6582* (2013.01); *H01R 13/6586* (2013.01); *H01R 13/6587* (2013.01); *H01R 13/6595* (2013.01)

(58) Field of Classification Search

CPC ..... H01R 13/6582; H01R 23/6873; H01R 13/6587; H01R 23/668; H01R 13/6594; H01R 23/02; H01R 13/6586; H01R 13/6595

USPC .... 439/607.53, 660, 607.11, 607.32, 607.13, 439/676, 607.35, 607.36, 607.37, 607.38, 439/607.39, 607.4

See application file for complete search history.

(56) References Cited

U.S. PATENT DOCUMENTS 6,957,985 B1 * 10/2005 Wang ..... H01R 13/6456 439/677

2015/0229082 A1 * 8/2015 Yu ..... H01R 13/6587 439/607.11

FOREIGN PATENT DOCUMENTS

CN 1972025 A 5/2007

* cited by examiner

*Primary Examiner* — Abdullah A Riyami
*Assistant Examiner* — Justin M Kratt
(74) *Attorney, Agent, or Firm* — Wei Te Chung; Ming Chieh Chang

(57) ABSTRACT

An electrical connector includes an insulative housing and a metallic shield attached thereupon. The housing forms a mating cavity recessed rearwardly and inwardly from a front face of the housing with a mating tongue extending therein. A plurality of contacts are disposed in the housing with corresponding contacting sections exposed upon the mating tongue facing toward the mating cavity. The metallic shield includes a front plate covering the front face of the housing with an opening aligned with the mating cavity, and an extension inwardly extending from an inner peripheral edge of the front plate around the opening, into the mating cavity and opposite to the mating tongue in the vertical direction.

20 Claims, 5 Drawing Sheets

(51) Int. Cl.

| | |
|---|---|
| *H01R 13/6595* | (2011.01) |
| *H01R 13/6586* | (2011.01) |
| *H01R 13/6582* | (2011.01) |
| *H01R 12/72* | (2011.01) |

ELECTRICAL CONNECTOR WITH METALLIC SHELL CURVED EXTENDING AND COVERING AN INTERIOR SURFACE OF A MATING CAVITY

BACKGROUND OF THE INVENTION

1. Field of the Invention

The present invention relates to an electrical connector, and particularly to the electrical connector equipped with a metallic shield having a front face and an inwardly extending capsular collar covering an interior surface of the mating cavity.

2. Description of Related Art

As well known, the traditional electrical connector includes an insulative housing enclosed within a metallic shield. Some types of connectors have the corresponding mating cavities while the corresponding metallic shield fails to intimately surround the corresponding mating cavity for the desired shielding effect.

SUMMARY OF THE INVENTION

The invention is to provide an electrical connector with an insulative housing and a metallic shield attached thereupon. The housing forms a mating cavity recessed rearwardly and inwardly from a front face of the housing with a mating tongue extending therein. A plurality of contacts are disposed in the housing with corresponding contacting sections exposed upon the mating tongue facing toward the mating cavity. The metallic shield includes a front plate covering the front face of the housing with an opening aligned with the mating cavity, and an extension inwardly extending from an inner peripheral edge of the front plate around the opening, into the mating cavity and opposite to the mating tongue in the vertical direction.

DETAILED DESCRIPTION OF THE PREFERRED EMBODIMENT

Figure 1:
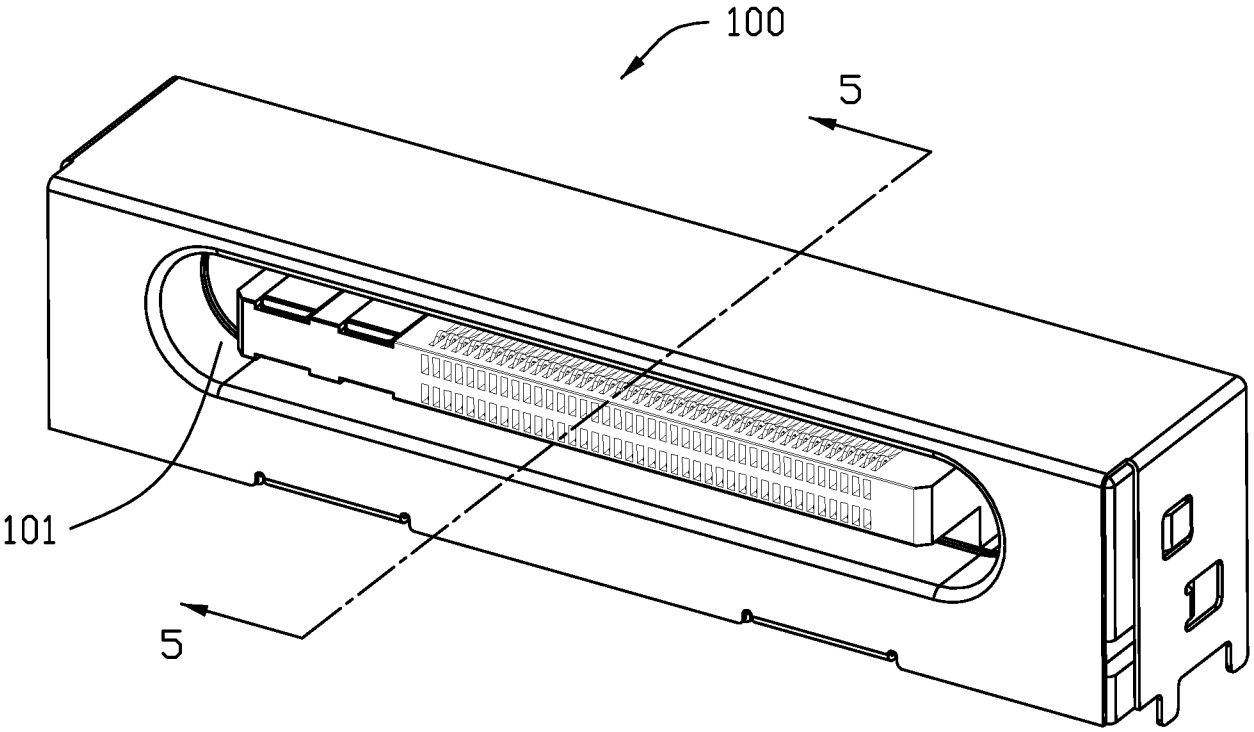
FIG. 1 is a perspective view of an electrical connector according to the invention.
Figure 2:
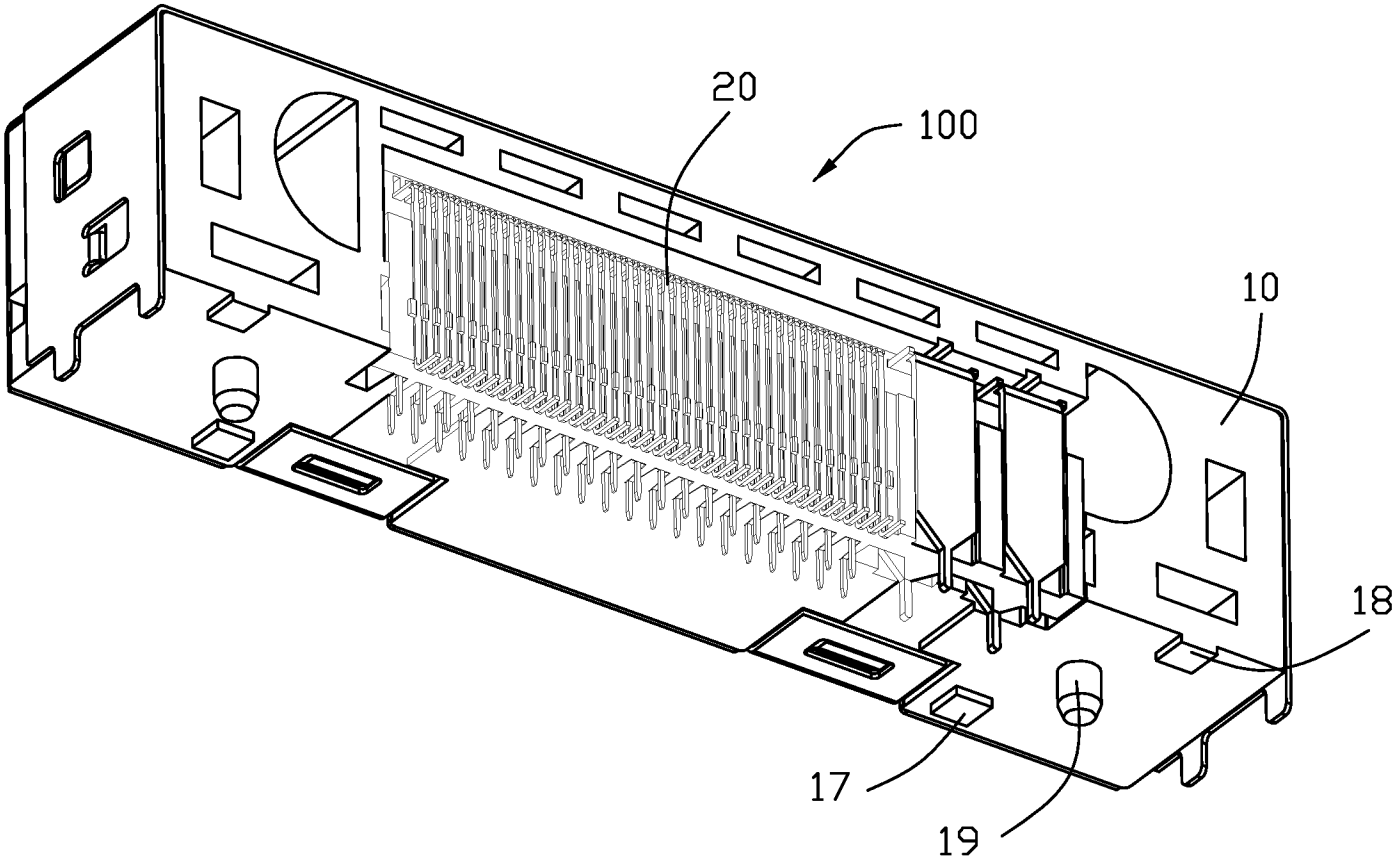
FIG. 2 is another perspective view of the electrical connector of FIG. 1.
Figure 3:
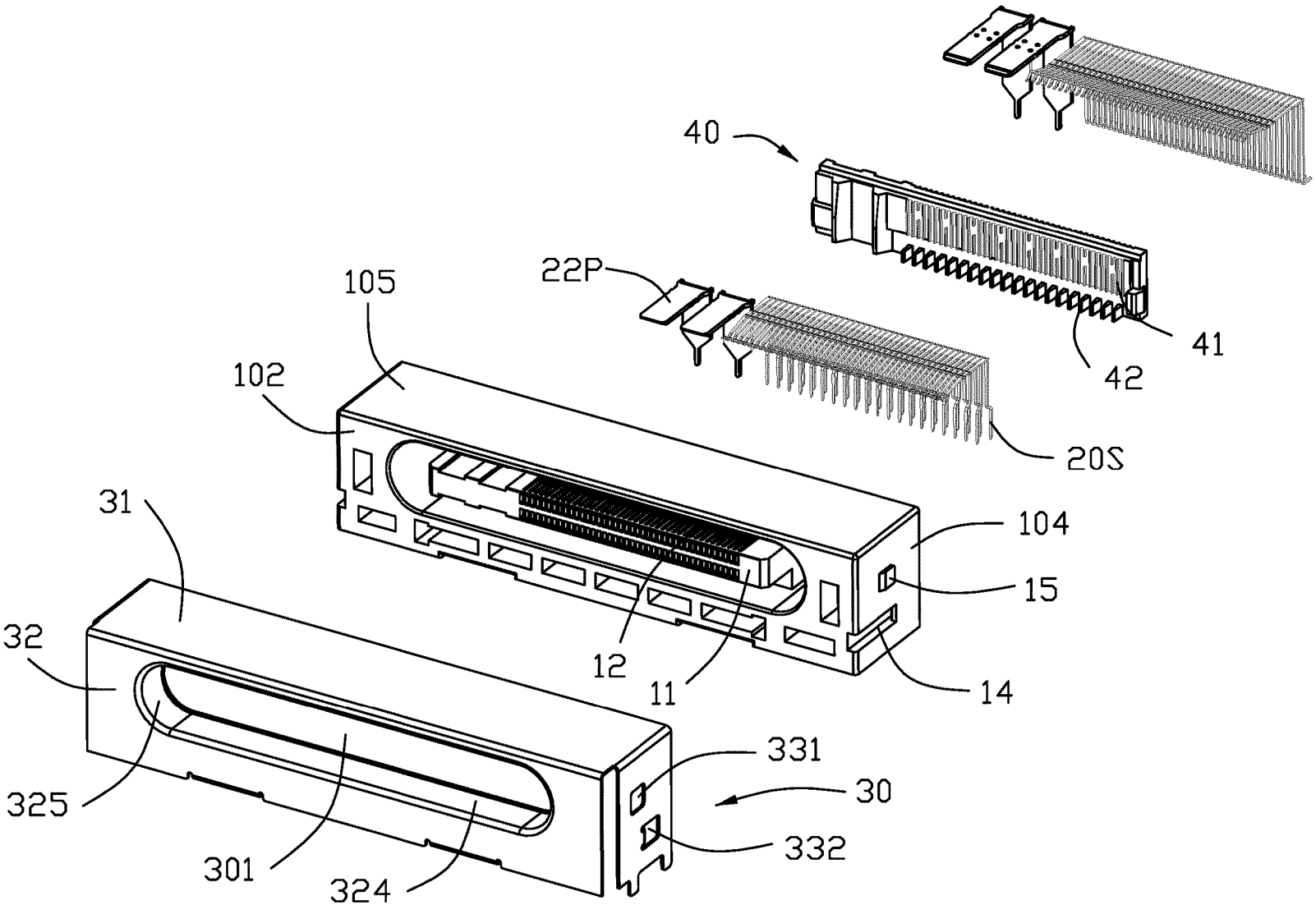
FIG. 3 is an exploded perspective view of the electrical connector of FIG. 1.
Figure 4:
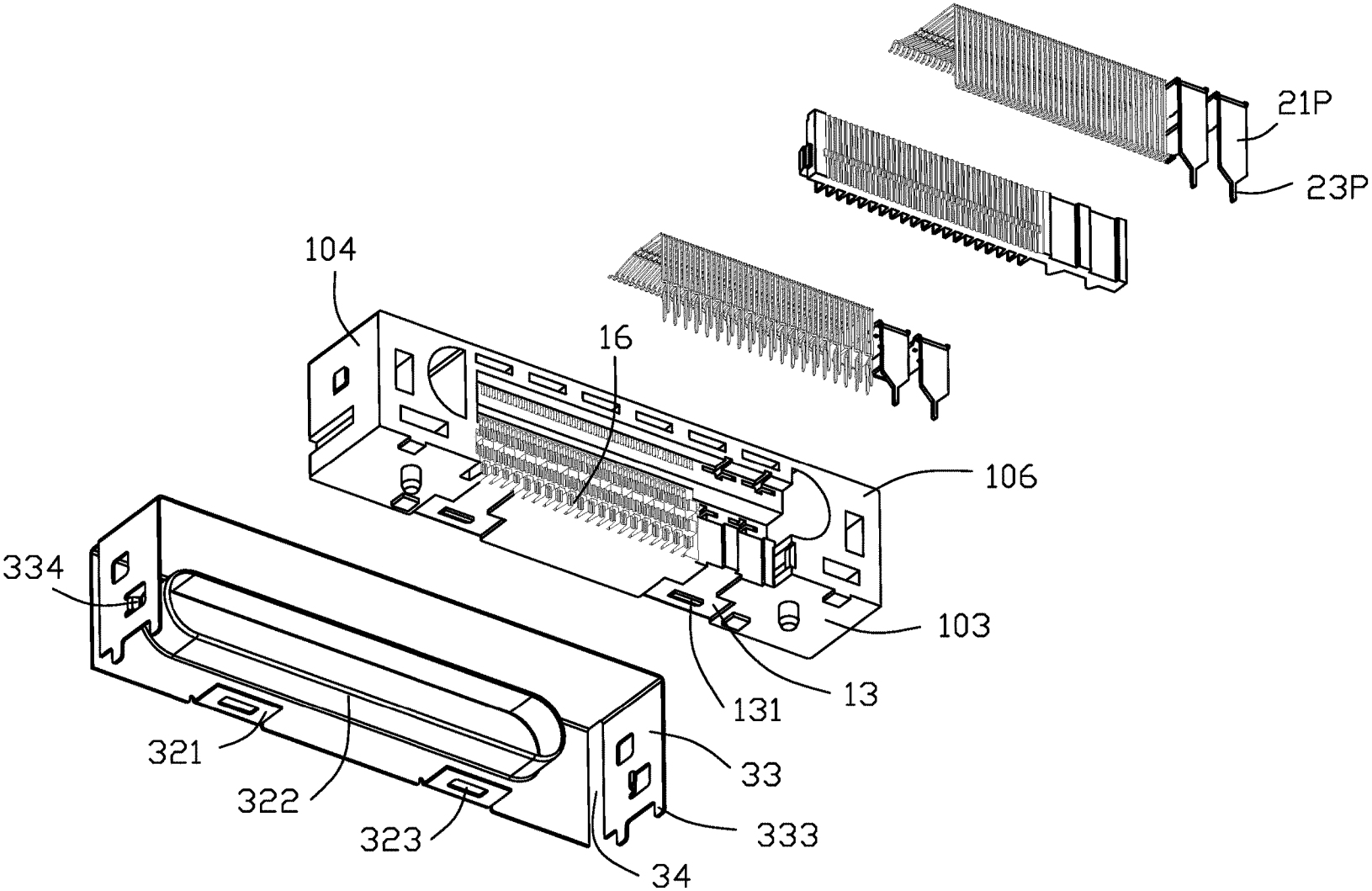
FIG. 4 is another exploded perspective view of the electrical connector of FIG. 1.

Referring to FIGS. 1-5, an electrical connector 100 includes an insulative housing 10, a plurality of contact 20, and a metallic shield 30 attached upon the housing 10.

The housing 10 includes a front face 102 and a rear face 106, a top face 105 and a bottom face 103, and two opposite side faces 104. The housing 10 forms a mating cavity 101 recessed inwardly from the front face 102 thereof, and a mating tongue 11 extends in the mating cavity 101. A plurality of passageways 12 are formed in the housing 10 and exposed upon the mating tongue 11. A pair of recesses 13 are formed in a bottom face 103 of the housing 10, and each of the recesses 13 has a protrusion 131 therein. Each side face 104 of the housing further forms a protrusion 15 thereon and a groove 14 therein. A pair of standoffs 17 and another pair of standoffs 18 are formed on the bottom face 103 of the housing 10. A pair of posts 19 extend downwardly from the bottom face 103 of the housing 10. Each post 19 is located between the corresponding standoffs 17 and 18 in an oblique direction.

The contacts 20 are disposed in the housing 10 in two rows and include the power contacts 20P and the signal contacts 20S. The signal contact 20S includes the retaining section 21S, the contacting section 22S extending from the retaining section 21S into the mating cavity 101, and a mounting section 23S extending from the retaining section 21S out of the housing 10. The power contact 20P includes a retaining portion 21P, the contacting portion 22P extending from the retaining portion 21P into the mating cavity 101, and a mounting portion 23P extending from the retaining portion 21P out of the housing 10. The contacting sections 22S and the contacting portions 22P are exposed upon the mating tongue 11 in a deflectable manner.

The metallic shield 30 includes a top plate 31, a front plate 32 downwardly extending from a front edge of the top plate 31, and a pair of side plates 33 extending downwardly from two opposite lateral side edges of the top plate 31. The front plate 32 is spaced from the side plate 33 with a gap 34. The top plate 31 covers the top face 105 of the housing 10, the front plate 32 covers the front face 102 of the housing 10, and the two side plates 33 cover the corresponding two side faces 104 of the housing 10. The front plate 32 further forms a pair of securing sections 321 with corresponding holes 323 for engagement with the corresponding protrusions 131, and an opening 301 in alignment with the mating cavity 101 with an extension 322 extending from inner peripheral edge around the opening 301 inwardly and rearwardly to cover an interior surface of the housing 10 around the mating cavity 101. Each side plate 33 includes a retention hole 331 receiving the corresponding protrusion 15, an engagement tab 334 derived from an hole 332 for engagement within the groove 14, and a pair of mounting legs 333. The extension 322 includes a pair of horizontally extending long sides 324 and a pair of curvedly extending short sides 325 linked between the pair of long sides 324, thus forming a capsular configuration thereof. Notably, in this embodiment the extension 322 extends continuously along the whole peripheral inner edge of the opening 301 in a complete manner via a deep drawing manufacturing process.

A spacer 40 is attached to a rear portion of the housing 10 to separate the two rows of contacts 20 in the front-to-back direction, and includes a plurality of grooves 41 to retain the contacts 20, and a plurality of partitions 42 to interengage with with a plurality of dividers 16 of the housing 10 in a mutually alternate manner for not only separating and retaining the contacts 20 but also reinforcing the housing 10.

Figure 5:
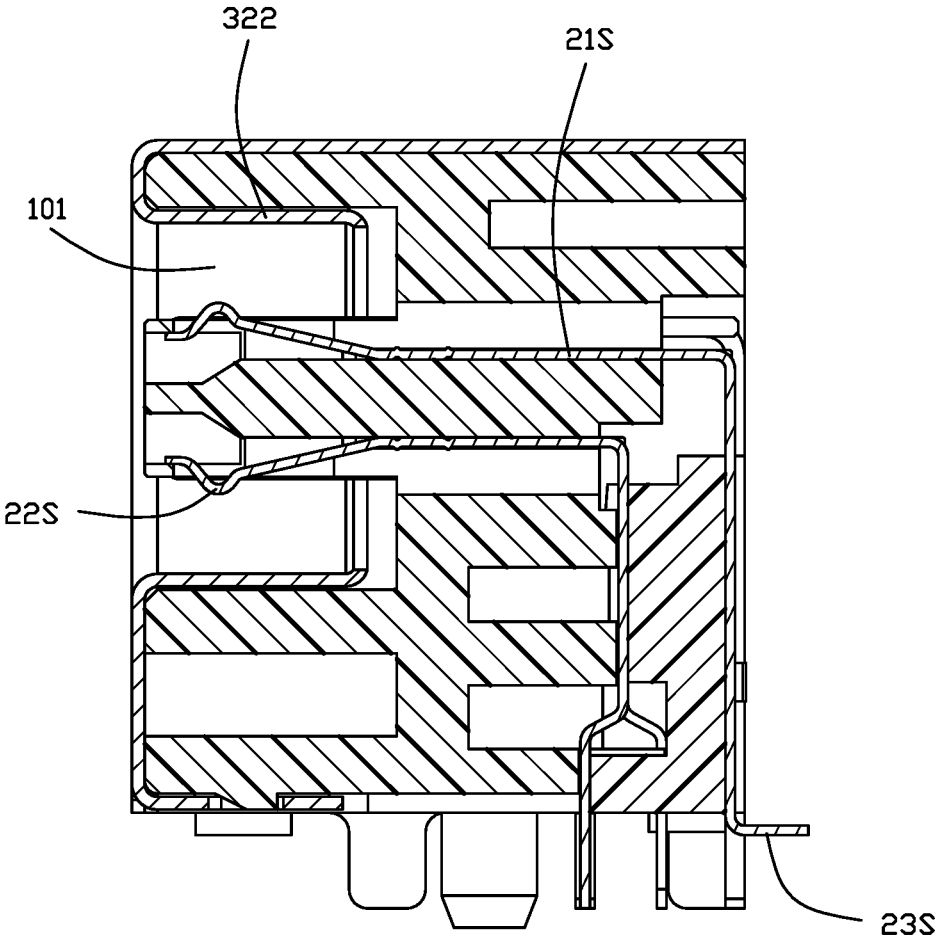
FIG. 5 is a cross-sectional view of the electrical connector of FIG. 1, taking along line 5-5 in FIG. 1.

Understandably, the extension 322 is exposed in the mating cavity 101 and directly faces the mating tongue 11 so as to perform a superior shielding effect, compared with the traditional design with the metallic shield covering the exterior surface of the housing farther from the mating cavity. Notably, in this embodiment the metallic shield 30 is rearwardly assembled onto the housing 10 along the front-to-back direction so as to allow the extension 322 to be compliantly received within the mating cavity 10. Thus, the horizontally extending groove 14 may guide the corresponding engagement tab 334 during assembling. As shown in FIG. 5, the spacer 4 divides the upper row of contacts 20 and the lower row of contacts 20 from each other wherein in the lower row of contacts 20 the primary vertical sections are located in a same vertical plane while the end regions of the vertical sections are arranged with two rows to be compliantly sandwiched between the mutually alternately arranged partitions 42 and dividers 16 in the front-to-back direction. It is also noted that as shown in all figures the housing 10 further forms a plurality of blind holes (not labeled) for keeping proper even thicknesses along the whole housing 10 and assuring injection molding quality without warpage thereof.

However, the disclosure is illustrative only, changes may be made in detail, especially in matter of shape, size, and arrangement of sections within the principles of the invention.

What is claimed is:

1. An electrical connector comprising:

an insulative housing including opposite front and rear faces, opposite top and bottom faces, and two opposite side faces, a mating cavity recessed rearwardly from the front face, and a mating tongue extending horizontally in the mating cavity;

upper and lower rows of contacts disposed in the housing with corresponding contacting sections exposed upon the mating cavity; and a metallic shield having a front plate covering the front face, a top plate covering the top face and a pair of side plates covering the two opposite side faces; wherein said front plate forms an opening in alignment with the mating cavity in a front-to-back direction, and an extension extending rearwardly from a peripheral inner edge of the front plate around said opening into the mating cavity to cover an interior surface of the housing around said mating cavity and directly face the mating tongue.

2. The electrical connector as claimed in claim 1, wherein both said mating cavity and said extension are capsular.

3. The electrical connector as claimed in claim 1, wherein said pair of side plates unitarily extend from two opposite lateral side edges of the top plate while spaced from the front plate with gaps therebetween, and said top plate unitarily extends from a top edge of the front plate.

4. The electrical connector as claimed in claim 3, wherein each of said side plates includes means for securing to the corresponding side face of the housing.

5. The electrical connector as claimed in claim 3, further including a pair of securing sections extending from a bottom edge of the front plate and fixed to the bottom face of the housing.

6. The electrical connector as claimed in claim 3, wherein each of said side plates includes an engagement tab to be received within a horizontally extending groove in the corresponding side face of the housing.

7. The electrical connector as claimed in claim 1, further including a spacer assembled to a rear portion of the housing to separate mounting sections of said two rows of contacts;

wherein the spacer forms a plurality of partitions that interengage corresponding dividers formed on the housing in a mutually alternate manner to separate and retain the contacts.

8. The electrical connector as claimed in claim 7, wherein in the lower row of contacts, rear vertical sections are primarily all arranged in a same vertical plane while end regions of the vertical sections are arranged with two rows to be compliantly sandwiched between the partitions and dividers in a front-to-back direction.

9. The electrical connector as claimed in claim 1, wherein said contacting sections are deflectable in a vertical direction.

10. A metallic shield for attaching upon an insulative housing of an electrical connector having a mating cavity with a mating tongue therein, comprising:

a front plate defining a capsular opening;

a capsular extension extending from a peripheral inner edge of the opening;

a top plate unitarily extending from a top edge of the front plate;

a pair of side plates unitarily extending from two opposite lateral side edges of the top plate; wherein each of said side plates includes an opening and an engagement tab for securing to the housing of the electrical connector.

11. The metallic shield as claimed in claim 10, wherein a gap is formed between each of said side plates and the front plate.

12. An electrical connector comprising:

an insulative housing including opposite front and rear faces, opposite top and bottom faces, and two opposite side faces, a mating cavity recessed rearwardly from the front face;

upper and lower rows of contacts disposed in the housing with corresponding contacting sections extending into the mating cavity; and a metallic shield having a front plate covering the front face, a top plate covering the top face and a pair of side plates covering the two opposite side faces; wherein said front plate forms an opening in alignment with the mating cavity in a front-to-back direction, and an extension extending rearwardly from a peripheral inner edge of the front plate around said opening into the mating cavity to cover an interior surface of the housing around said mating cavity and directly face the contacting sections.

13. The electrical connector as claimed in claim 12, wherein both said mating cavity and said extension are capsular.

14. The electrical connector as claimed in claim 12, wherein said pair of side plates unitarily extend from two opposite lateral side edges of the top plate while spaced from the front plate with gaps therebetween, and said top plate unitarily extends from a top edge of the front plate.

15. The electrical connector as claimed in claim 14, wherein each of said side plates includes means for securing to the corresponding side face of the housing.

16. The electrical connector as claimed in claim 14, further including a pair of securing sections extending from a bottom edge of the front plate and fixed to the bottom face of the housing.

17. The electrical connector as claimed in claim 14, wherein each of said side plates includes an engagement tab to be received within a horizontally extending groove in the corresponding side face of the housing.

18. The electrical connector as claimed in claim 12, further including a spacer assembled to a rear portion of the housing to separate mounting sections of said two rows of contacts; wherein the spacer forms a plurality of partitions that interengage corresponding dividers formed on the housing in a mutually alternate manner to separate and retain the contacts.

19. The electrical connector as claimed in claim 18, wherein in the lower row of contacts, rear vertical sections are primarily all arranged in a same vertical plane while end regions of the vertical sections are arranged with two rows to be compliantly sandwiched between the partitions and dividers in a front-to-back direction.

20. The electrical connector as claimed in claim 12, wherein said contacting sections are deflectable in a vertical direction.

* * * * *